US009814333B2

(12) United States Patent
Vernon et al.

(10) Patent No.: US 9,814,333 B2
(45) Date of Patent: Nov. 14, 2017

(54) INFUSION/DISPERSION DEVICE

(71) Applicant: Helen of Troy Limited, Belleville, St. Michael (BB)

(72) Inventors: Ryan Vernon, New York, NY (US); Timothy Jude Kennedy, Leonia, NJ (US); Sherwood Forlee, Davis, CA (US); Jens Johnson, Austin, TX (US); Benjamin Jeffrey Stein, New York, NY (US)

(73) Assignee: Helen of Troy Limited, Belleville, St. Michael (BB)

( * ) Notice: Subject to any disclaimer, the term of this patent is extended or adjusted under 35 U.S.C. 154(b) by 427 days.

(21) Appl. No.: 14/380,171

(22) PCT Filed: Feb. 22, 2013

(86) PCT No.: PCT/US2013/027365

§ 371 (c)(1),
(2) Date: Aug. 21, 2014

(87) PCT Pub. No.: WO2013/130353

PCT Pub. Date: Sep. 6, 2013

(65) Prior Publication Data

US 2015/0020690 A1 Jan. 22, 2015

Related U.S. Application Data

(60) Provisional application No. 61/603,619, filed on Feb. 27, 2012, provisional application No. 61/738,116, filed on Dec. 17, 2012.

(51) Int. Cl.
*A47G 19/16* (2006.01)

(52) U.S. Cl.
CPC ..... *A47G 19/16* (2013.01)

(58) Field of Classification Search
CPC ..... A47G 19/16; A47J 31/005; A47J 31/18; A47J 31/20; A47J 31/06; A47J 31/0615
(Continued)

(56) References Cited

U.S. PATENT DOCUMENTS 1,497,199 A 6/1924 Sutthoff
1,722,946 A * 7/1929 Raffa ..... A47J 36/22 210/471

(Continued)

FOREIGN PATENT DOCUMENTS

GB 578469 6/1946
JP 2003125949 5/2003

OTHER PUBLICATIONS

International Search Report filed in PCT/US13/27365 dated May 2, 2013.

*Primary Examiner* — Dana Ross
*Assistant Examiner* — Kuangyue Chen
(74) *Attorney, Agent, or Firm* — Rankin, Hill & Clark LLP

(57) ABSTRACT

An infusion/dispersion device includes a handle, a tube, a rod, and a basket. The handle includes a first section and a second section. The first section is rotatable with respect to the second section. The tube is connected fast with the first section of the handle. The rod is received in the tube and is connected fast with the second section of the handle. The basket includes an outer shell and an inner shell that is receivable in the outer shell. The outer shell connects fast with the tube and the inner shell connects fast with the rod such that rotation of the first section of the handle with respect to the second section of the handle results in rotation of the inner shell with respect to the outer shell.

17 Claims, 6 Drawing Sheets

(58) Field of Classification Search
USPC ..... 99/323, 279, 495
See application file for complete search history.

(56) References Cited

U.S. PATENT DOCUMENTS

| | | | | |
|---|---|---|---|---|
| 2,133,166 | A | 2/1938 | Fritsche | |
| 3,354,812 | A | 11/1967 | Gorton, Jr. | |
| 4,828,850 | A | 5/1989 | Davis | |
| 2006/0037176 | A1 | 2/2006 | McGuyer et al. | |
| 2006/0282988 | A1* | 12/2006 | Lin | B25G 1/04 16/429 |
| 2008/0028945 | A1* | 2/2008 | Almond | A47G 19/16 99/287 |
| 2011/0027012 | A1* | 2/2011 | Stahle | F16B 7/1463 403/109.4 |

* cited by examiner

INFUSION/DISPERSION DEVICE

BACKGROUND

A tea ball, also known as a tea infuser, is a device having a basket in which loose, dried tea leaves are placed for steeping in hot water. Oftentimes the basket is spherical in shape. Known tea balls can require the person making tea to handle the basket while filling or emptying the basket. Especially when emptying the basket, handling the basket can result in the person's hands getting wet and also the basket can be hot.

A flour wand is a device for applying a fine layer of flour onto dough. Known flour wands include a handle attached to a basket in which the flour is placed. Oftentimes the handle is spring-loaded to bias the basket toward a closed position. Having a spring-loaded handle can result in complications when loading flour into the basket of the flour wand.

SUMMARY

The device that will be described in more detail can be used for either infusion or dispersion. For example, the device could be used as a tea ball and operate as a tea infuser or the device could operate as a dispersion device, such as a flour wand or flour sifter, to disperse or apply a fine layer of flour onto dough.

Such a device includes a handle, a tube, a rod, and a basket. The handle includes a first section and a second section. The first section is rotatable with respect to the second section. The tube is connected fast with the first section of the handle. The rod is received in the tube and is connected fast with the second section of the handle. The basket includes an outer shell and an inner shell that is receivable in the outer shell. The outer shell connects fast with the tube and the inner shell connects fast with the rod such that rotation of the first section of the handle with respect to the second section of the handle results in rotation of the inner shell with respect to the outer shell.

DETAILED DESCRIPTION

Figure 1:
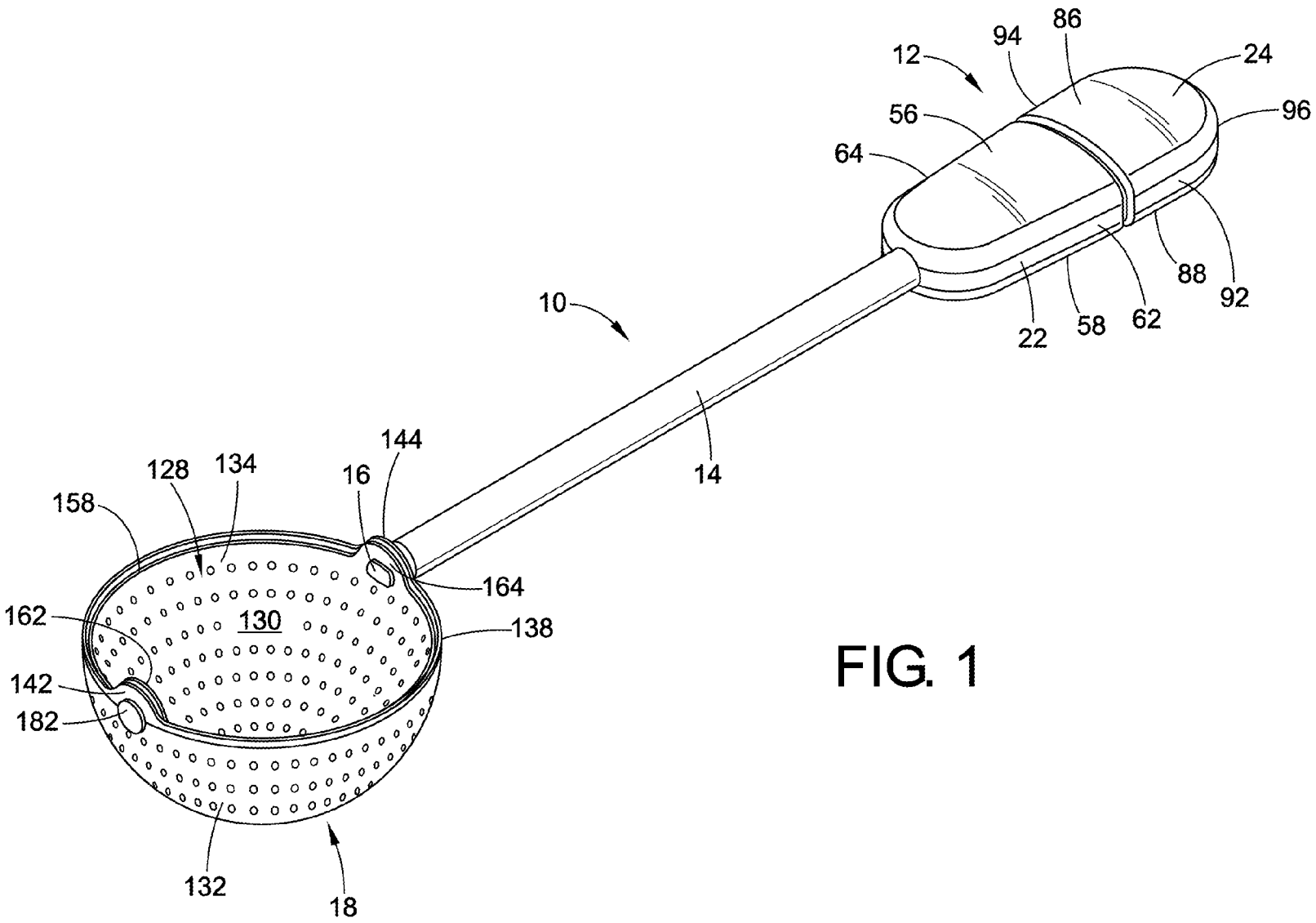
FIG. 1 is a perspective view of an infusion/dispersion device with a basket in an open position.
Figure 2:
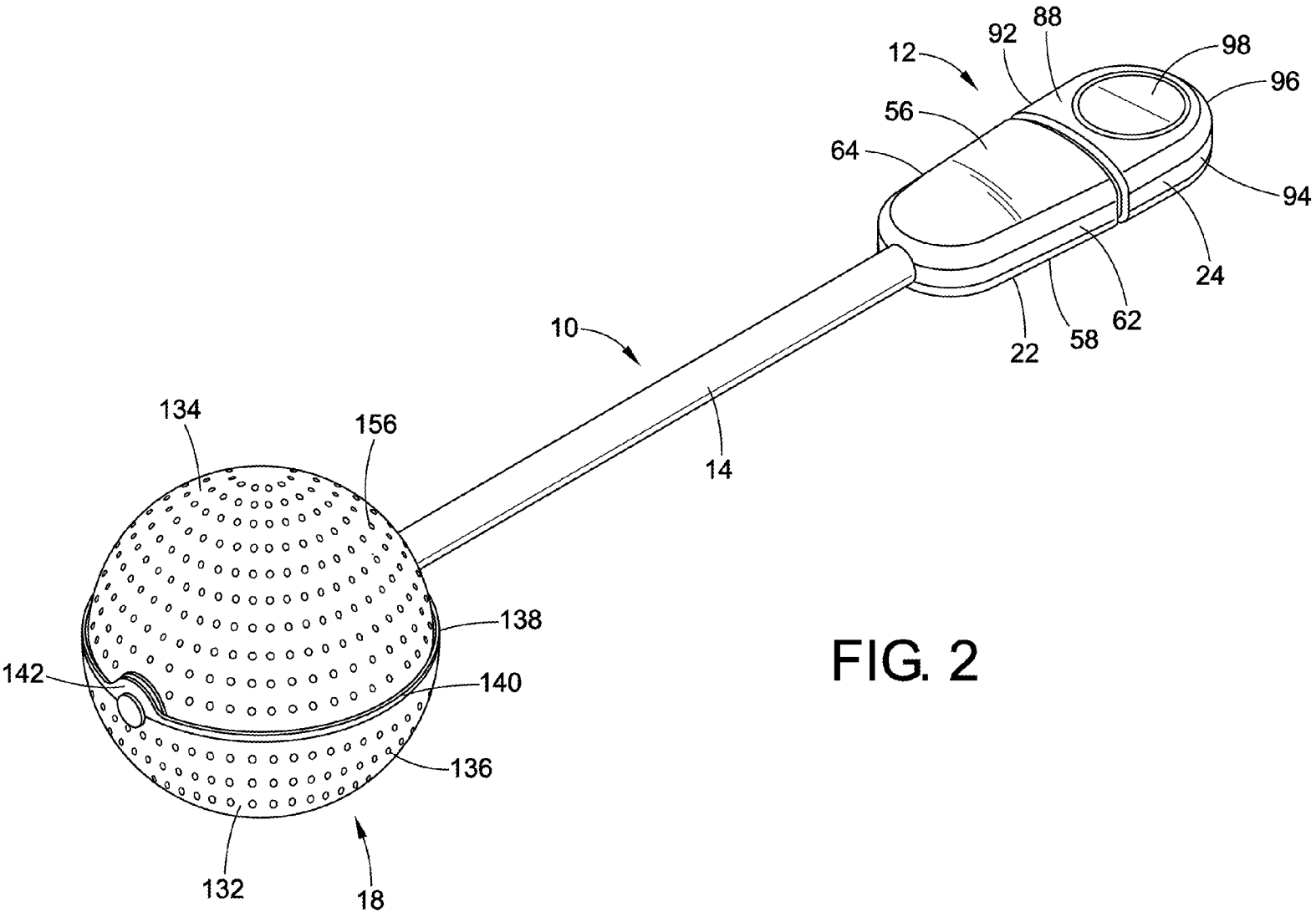
FIG. 2 is a perspective view of the device of FIG. 1 with the basket in a closed position.

FIGS. 1 and 2 disclose a hand-held device 10 that can operate as an infusion device or a dispersion device. When operating as an infusion device, the device 10 can operate as a tea ball that can be used for brewing tea. The device 10 can be used as a device for infusing other liquids or drinks as well. When operating as a dispersion device, the device 10 can operate as a flour wand or flour sifter, which can be used to disperse flour or other granulated materials, such as cinnamon or powdered sugar. The device 10 includes a handle 12, a tube 14, a rod 16, and a basket 18. When operating as a tea ball, tea leaves are placed into the basket 18 to brew tea. Other items, such as herbs and the like can also be placed into the basket. When brewing tea, the basket 18 is placed into a cup of hot water to allow the tea leaves disposed within the basket to steep within the water. When operating as a flour wand, granulated materials to be distributed are placed into the basket 18. The device 10 is shaken over dough to disperse a fine layer of flour. Even though the device 10 may be referred to as a flour wand, it can be used to disperse other granulated materials such as cocoa powder, sugar and cinnamon. Any granulated material that can be "dusted" across a surface can be dispersed using the device 10.

In the illustrated embodiment, the handle 12 includes a first, or forward, section 22 and a second, or rear, section 24. The handle 12 can be made from plastic or another heat-insulative material. An operator can handle the device 10 by grasping the handle 12. In typical usage, the operator of the device 10 rotates the rear section 24 of the handle 12 with respect to the forward section 22 to move the basket 18 between an open position (FIG. 1) and a closed position (FIG. 2). Alternatively, the forward section 22 can be rotated with respect to the rear section 24 to move the basket 18 between the open position and the closed position.

Figure 3:
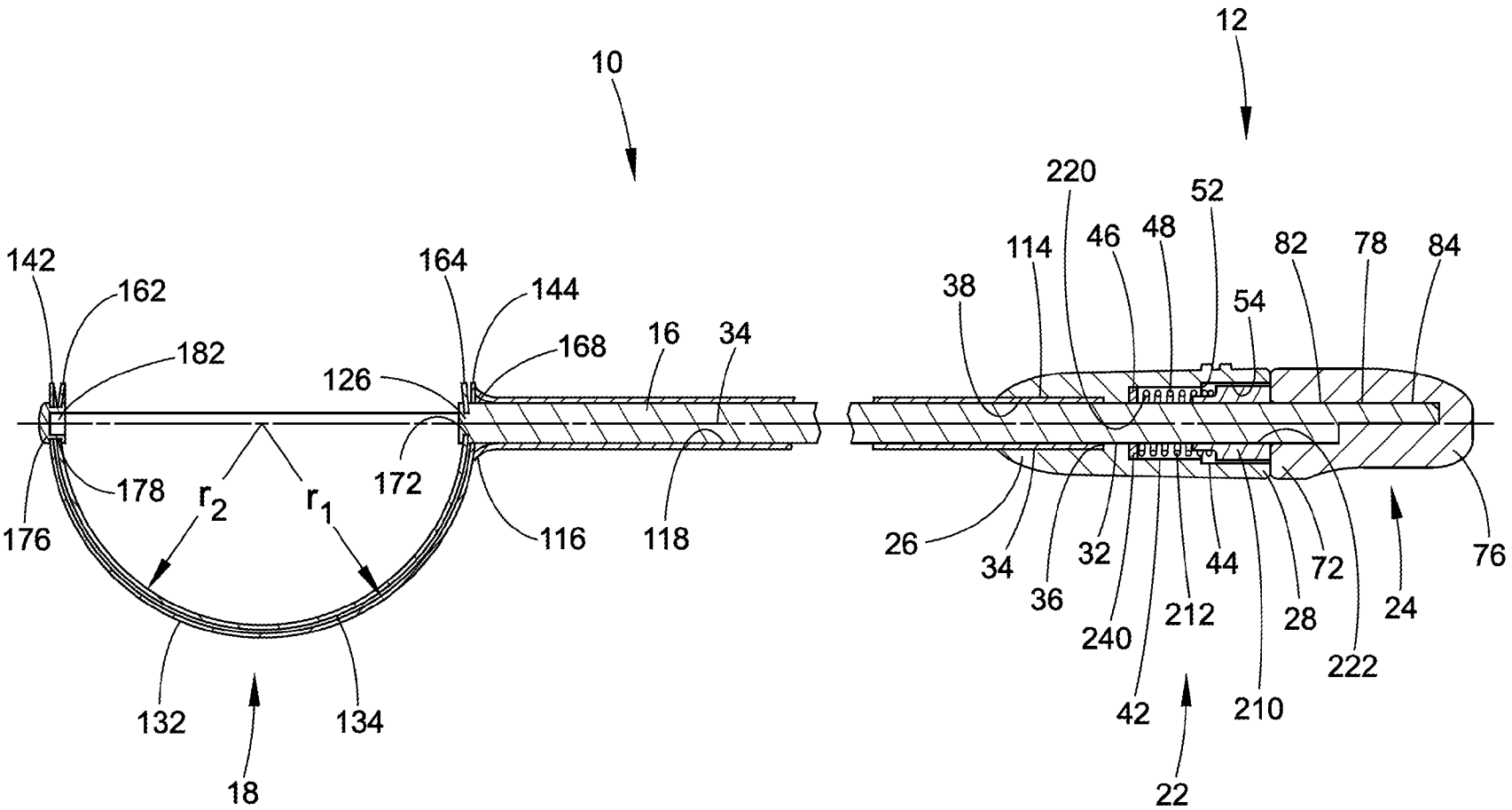
FIG. 3 is a side cross-sectional view of the device of FIG. 1.

With reference to FIG. 3, the forward section 22 includes a forward end 26, which is nearer the basket 18, and a rear end 28. The forward section 22 includes an axial through bore 32, which is coaxial with a rotational axis 34 of the rod 16. The through bore 32 extends entirely through the forward section 22 from the rear end 28 to the forward end 26. The rod 16 is received in and extends through the through bore 32. The forward section 22 further includes a forward counterbore 34, which is aligned with and forms part of the through bore 32. The forward counterbore 34 extends inwardly from the forward end 26 of the forward section 22 toward the rear end 28. The forward counterbore 34 is defined by an annular shoulder 36, which is normal to the rotational axis 34, and an interior cylindrical surface 38. The forward section 22 of the handle 12 further includes a cylindrical rear counterbore 42 and a non-cylindrical rear counterbore 44, which are each aligned with and form part of the through bore 32. The cylindrical rear counterbore 42 is defined by an annular shoulder 46, which is normal to the rotational axis 34, and an interior cylindrical inner surface 48. The non-cylindrical counterbore 44 is defined by a shoulder 52, which is normal to the rotational axis 34, and a non-cylindrical internal surface 54. The non-cylindrical counterbore 44 extends forwardly from the rear end 28 of the forward section 22 of the handle 12. The rear cylindrical bore 42 extends forwardly from the shoulder 52 that defines the non-cylindrical counterbore 44.

With reference back to FIGS. 1 and 2, the forward section 22 further includes an upper external surface 56, a lower external surface 58, an external first side surface 62, and an external second side surface 64. In the illustrated embodiment, the upper external surface 56 and the lower external surface 58 are each wider than the respective side surfaces 62 and 64. Additionally, the upper external surface 56 and the lower external surface 58 are each substantially planar. Also, the first side surface 62 and the second side surface 64, which each interconnect the respective upper and lower surfaces 56 and 58, are also substantially planar.

The rear section 24 of the handle 12 is rotatable with respect to the forward section 22 about the rotational axis 34 (FIG. 3). The rear section 24 includes a forward end 72 and a rearward end 76. The rear section 24 further includes a keyed axial counterbore 78 that receives the rod 16. The axial counterbore 78 includes a cylindrical section 82 and a non-cylindrical section 84. The keyed axial counter bore 78 receives the rod 16. The rod 16 connects fast with the rear section 24 such that rotation of the rear section 24 with respect to the forward section 22 results in rotation of the rod 16 with respect to the forward section 22.

With reference back to FIG. 1, the rear section 24 also includes an upper external surface 86 and a lower external surface 88. Also, the rear section 24 further includes an external first side surface 92 and an external second side surface 94. The upper external surface 86 and the lower external surface 88 are each wider than the respective external side surfaces 92 and 94. As seen in FIG. 1, the rear section 24 further includes a curved rear surface 96, which interconnects the first side surface 92 to the second side surface 94 and the upper surface 86 to the lower surface 88. The rear section 24 can further include a dimple 98 (FIG. 1) formed in the lower external surface 88. If desired, a similar dimple (not shown) can be provided in the upper external surface 86.

The width of the rear section 24 is measured perpendicular to the rotational axis 34 between the external first side surface 92 and the external second side surface 94. The width of the forward section 22 is measured perpendicular to the rotational axis 34 between the external first side surface 62 and the external second side surface 64. When the basket 18 is in both the open position (FIG. 1) and the closed position (FIG. 2), the width of the rear section 24 is substantially parallel with the width of the forward section 22. In contrast, as the rear section 24 is rotated about the rotational axis 34 to move the basket 18 from the closed position to the open position, or vice versa, the width of the rear section is no longer parallel with the width of the forward section 22. Also, when the basket 18 is in both the open position (FIG. 1) and the closed position (FIG. 2), the width of the of the rear section 24 is substantially equal with the width of the forward section 22 adjacent where the rear section 24 is nearest the forward section 22. The upper external surface 86 is aligned with the upper external surface 56 in that a parting line separating the forward section 22 from the rear section 24 provides the discontinuity between the two surfaces. The side surfaces 62, 64, 92 and 94 are aligned in the same manner.

The handle 12 can be configured such that the upper external surface 86 of the rear section 24 aligns with the upper external surface 56 of the forward section 22 when the basket 18 is in both a closed and open position. Likewise, the side surfaces 92 and 94 of the rear section 24 can align with the side surfaces 62 and 64, respectively, of the forward section 22 when the basket 18 is in both the open position and closed position.

The height of the rear section 24 is measured perpendicular to the rotational axis 34 between the upper external surface 86 and the lower external surface 88. The height of the forward section 22 is measured perpendicular to the rotational axis 34 between the upper external surface 56 and the lower external surface 58. When the basket 18 is in both the open position (FIG. 1) and the closed position (FIG. 2), the height of the of the rear section 24 is substantially parallel with the height of the forward section 22. In contrast, as the rear section 24 is rotated about the rotational axis 34 to move the basket 18 from the closed position to the open position, or vice versa, the height of the rear section is no longer parallel with the width of the forward section 22. Also, when the basket 18 is in both the open position (FIG. 1) and the closed position (FIG. 2), the height of the of the rear section 24 is substantially equal with the height of the forward section 22 adjacent where the rear section 24 is nearest the forward section 22.

The handle 12 can take other configurations. It can be desirable that the handle not be a revolved shape, e.g., sphere or cylinder, having a central axis coaxial with a central axis of the basket 18. A handle not being a revolved shape inhibits the hand-held device 10 from rolling along a surface, e.g., a table, when the device 10 is laid on the surface.

With reference back to FIGS. 1 and 2, the tube 14 connects the handle 12 to the basket 18. More particularly, the tube 14 connects fast with the forward section 22 of the handle 12 to the basket 18. In the illustrated embodiment, the tube 16 is elongated and coaxial with the rotational axis 34. With reference to FIG. 3, the tube 14 includes a rear end 114 that is received in the forward counterbore 34 of the forward section 22 of the handle 12. The tube 14 connects with the handle by way of a press fit in the illustrated embodiment. The tube 14 also includes a forward end 116 that connects with the basket 18. The tube 14 includes an elongate passage 118 extending axially through the tube 14 from the rear end 114 to the forward end 116. The elongate passage 118 is also coaxial with the rotational axis 34.

The rod 16 is received in the elongate passage 118 formed by the tube 14. The rod 16 extends entirely through the elongate passage 118. The rod 16 further extends entirely through the through bore 32 of the forward section 22 of the handle 12 and extends rearwardly beyond the rear end 28 of the forward section 22. In the illustrated embodiment, and with reference to FIG. 5, the rod 16 includes a keyed section 122 formed at a rearward end 124 of the rod. The keyed section 122 is non-circular in configuration in a cross-section taken normal to the rotational axis 34. With reference back to FIGS. 3 and 4, the keyed section 122 of the rod 16 is received in the non-circular section 84 of the keyed counter bore 78 formed in the rear section 24 of the handle 12. The rod 16 connects fast with the rear section 24 of the handle 12 such that rotation of the rear section 24 with respect to the forward section 22 about the rotational axis 34 results in rotation of the rod 16 about the rotational axis. The rod 16 also includes a forward end 126 that connects with the basket 18.

With reference to FIG. 1, the basket 18 defines a chamber 130. When the device 10 is used as a tea ball, the basket 18 can be for retaining tea leaves. When the device 10 is used as a flour wand, the basket 18 defines a chamber 130 for retaining granulated material. In the illustrated embodiment, the basket 18 includes an outer shell 132 and an inner shell 134 that is receivable within the outer shell. In the illustrated embodiment, the basket 18 is movable into a closed position (FIG. 2) where the basket 18 is generally spherical in configuration and an open position (FIG. 1) where the inner shell 134 is received within the outer shell 132 and the basket 18 is generally hemispherical in configuration. The basket 18 can take alternative configurations. For example, when the basket 18 is in the closed position the basket could be a revolved shape other than a sphere, e.g., a cylinder. The shape of the inner shell 134 and the outer shell 132 would change to accommodate the new shape of the basket 18. In either configuration, a sphere or another revolved shape, the basket 18 is movable into a closed position where the basket confines articles larger than openings or perforations 136 and 156 (described below) within the basket and an open position where the inner shell is received within the outer shell and the basket defines a filling opening 128 through which the articles can be loaded into the basket. The forward section 22 of the handle 12 rotates 180 degrees with respect to the rear section 24 of the handle 12, or vice versa, when the basket 18 is moved from the open position to the closed position. In the illustrated embodiment, each of the outer shell 132 and the inner shell 134 are made from stainless steel sheet material, or other durable material. The outer shell 132 and the inner shell 134 could also be made from a wire mesh material.

The outer shell 132 is generally hemispherical and includes a plurality of perforations 136. The perforations 136 can allow for the ingress of water into the chamber 130 when the basket 18 is in the closed position shown in FIG. 2. The perforations 136 can also allow for the egress of granulated material, e.g., flour and sugar, from the chamber 130 when the basket 18 is in the closed position shown in FIG. 2. The outer shell 132 further includes a substantially circular edge 138 and a short cylindrical section 140. The short cylindrical section 140 provides an overlap between the outer shell 132 and the inner shell 134 when the basket 18 is in the closed position, which can accommodate for tolerances between the outer shell 132 and the inner shell 134. The outer shell 132 further includes a forward ear 142 that extends upwardly from the circular edge 138 and is aligned with the rotational axis 34. The outer shell 132 further includes a rearward ear 144 that is aligned with the forward ear 142 and the rotational axis 34. With reference to FIG. 3, the forward end 116 of the tube 14 contacts and connects with the outer shell 132 at the rearward ear 144. The tube 14 terminates at the forward end 116, which contacts the outer shell 132, and connects fast with the outer shell 132 such that movement, e.g., rotation, of the tube 14 results in movement, e.g., rotation, of the outer shell. The outer shell 132 has a radius $r_1$, which is measured from a point on the rotational axis 34.

The inner shell 134 also includes a plurality of perforations 156. The perforations 156 also allow for the ingress of water into the chamber 130 when the basket 18 is in the closed position. Like the apertures 136 in the outer shell 132, the perforations 156 in the inner shell 134 are designed to allow for the ingress of water but to preclude tea leaves from exiting the chamber 130 when the basket is in the closed position. The perforations 156 also allow for the egress of granulated material, e.g., flour and sugar, from the chamber 130 when the basket 18 is in the closed position. The inner shell 134 also includes a circular edge 158. When in the open position, the circular edge 158 of the inner shell is disposed coplanar with the circular edge 138 of the outer shell or slightly beneath the circular edge 138 of the outer shell 132. When the basket 18 is in the closed position, the circular edge 158 (not visible in FIG. 2) of the inner shell 134 is also disposed slightly below the circular edge 138 of the outer shell 132, which confines the tea leaves or granulated material within the chamber 130.

The perforations 136 in the outer shell 132 can be identical in size and shape having the same diameter. The perforations 156 on the inner shell 134 can also be identical in configuration and have the same diameter. The diameter of each of the perforations 136 on the outer shell 132 can be different than the diameter of the perforations 156 on the inner shell 134. For example, the diameter of the perforations 156 in the inner shell 134 could be larger than the diameter of the perforation 136 for the outer shell 132. This may be useful when the device 10 is operated as a flour wand. For example, the inner shell 134 could be pointed downward to allow for granulated material of a particular size to pass through larger diameter perforations 156 as compared to smaller diameter perforations 136 in the outer shell 132. If smaller diameter granular materials are desired, the orientation of the device 10 could be rotated 180 degrees about the rotational axis 34 such that the outer shell 132 is facing downwards. Also, only one of the shells may have perforations, which also may be beneficial for a flour wand. For example, the inner shell 134 would include the perforations 156, while the outer shell 132 would not be perforated. This could limit the egress of granulated material through the outer shell 132 as the flour or sugar is transferred from its original container to where it is to be dispersed. As mentioned above, the inner shell 134 and the outer shell 132 could also be made from a wire mesh material, and the perforations 136 and 156 discussed above, are also meant to include the openings between the individual wires.

The inner shell 134 also includes a forward ear 162, which is similarly shaped to the forward ear 142 of the outer shell 132, and a rearward ear 164, which is similarly shaped to the rearward ear 144 of the outer shell.

With reference back to FIG. 3, the rearward ear 144 of the outer shell 132 includes an opening 168, which is centered with respect to the rotational axis 34. The rearward ear 164 of the inner shell 134 also includes an opening 172, which is centered with respect to the rotational axis 34. The opening 168 in the outer shell 132 aligns with the opening 172 in the inner shell 134. Each opening 168 and 172 receives the rod 16. The forward end 126 of the rod 16 connects fast with the inner shell 134 such that rotation of the rod 16 with respect to the outer shell 132 results in rotation of the inner shell 134 with respect to the outer shell 132.

The forward ear 142 in the outer shell 132 includes a fastener opening 176, which is centered with respect to the rotational axis 34. The forward ear 162 of the inner shell 134 also includes a fastener opening 178, which is centered with respect to the rotational axis 34. A fastener 182 is received in the opening 176 found in the outer shell 132 and the opening 178 found in the inner shell 134 to connect the inner shell with the outer shell. The inner shell 134 also has a radius $r_2$, which emanates from a point on the rotational axis 34, and $r_2$ is less than $r_1$, which allows the inner shell 134 to be receivable within the outer shell 136.

Figure 4:
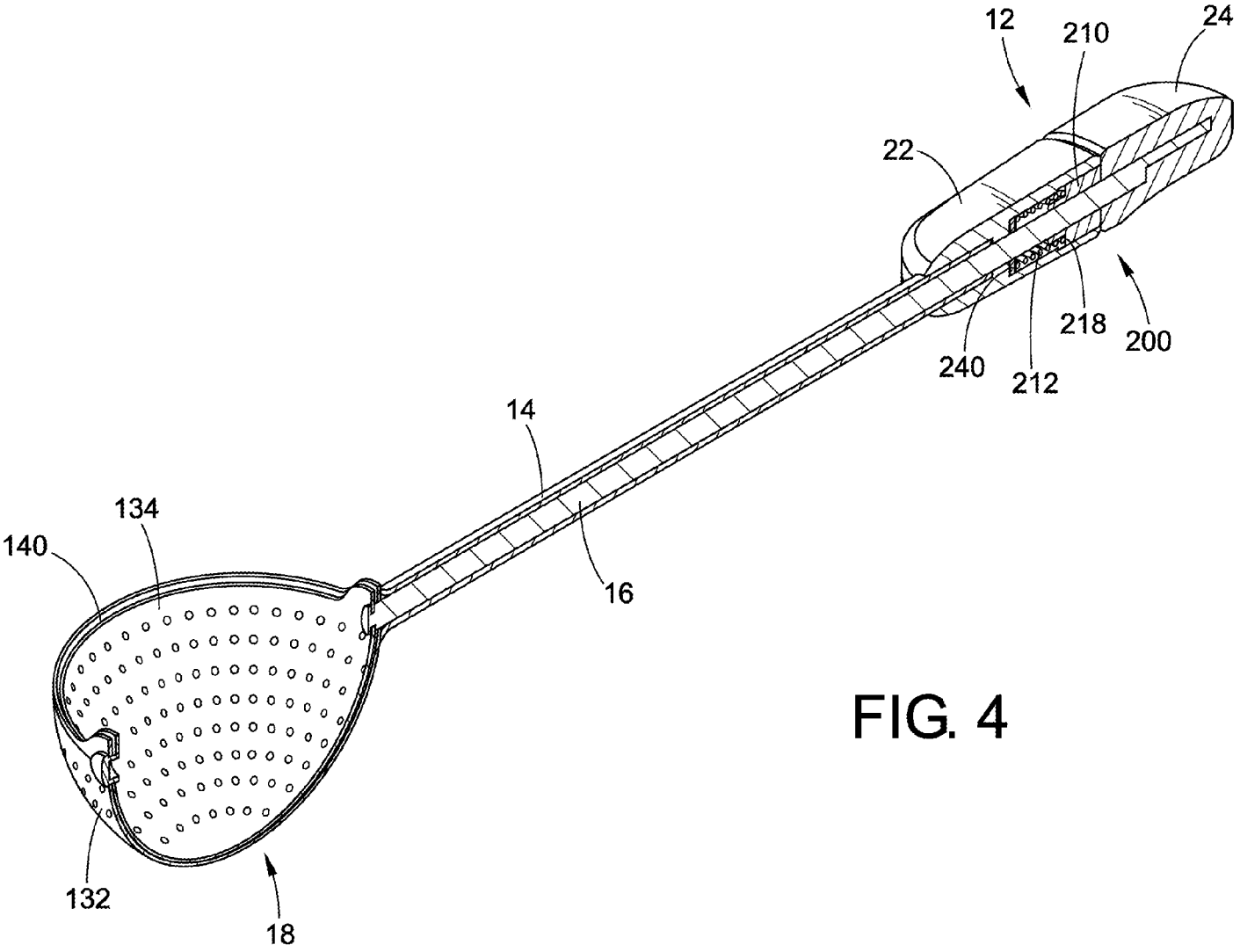
FIG. 4 is a perspective cross-sectional view of the device of FIG. 1.

With reference to FIG. 4, the device 10 can further include a detent mechanism 200, which inhibits rotational movement of the rear section 24 of the handle 12 with respect to the forward section 22 of the handle. The detent mechanism can also operate as a locking feature for the basket 18. The detent mechanism 200 is disposed in the handle 12, which spaces the locking feature of the basket 18 away from the basket. This allows the operator of the device 10 to lock the basket 18 in either the open position (FIG. 1) or the closed position (FIG. 2) without handling the basket, which can be wet after brewing tea.

Figure 6:
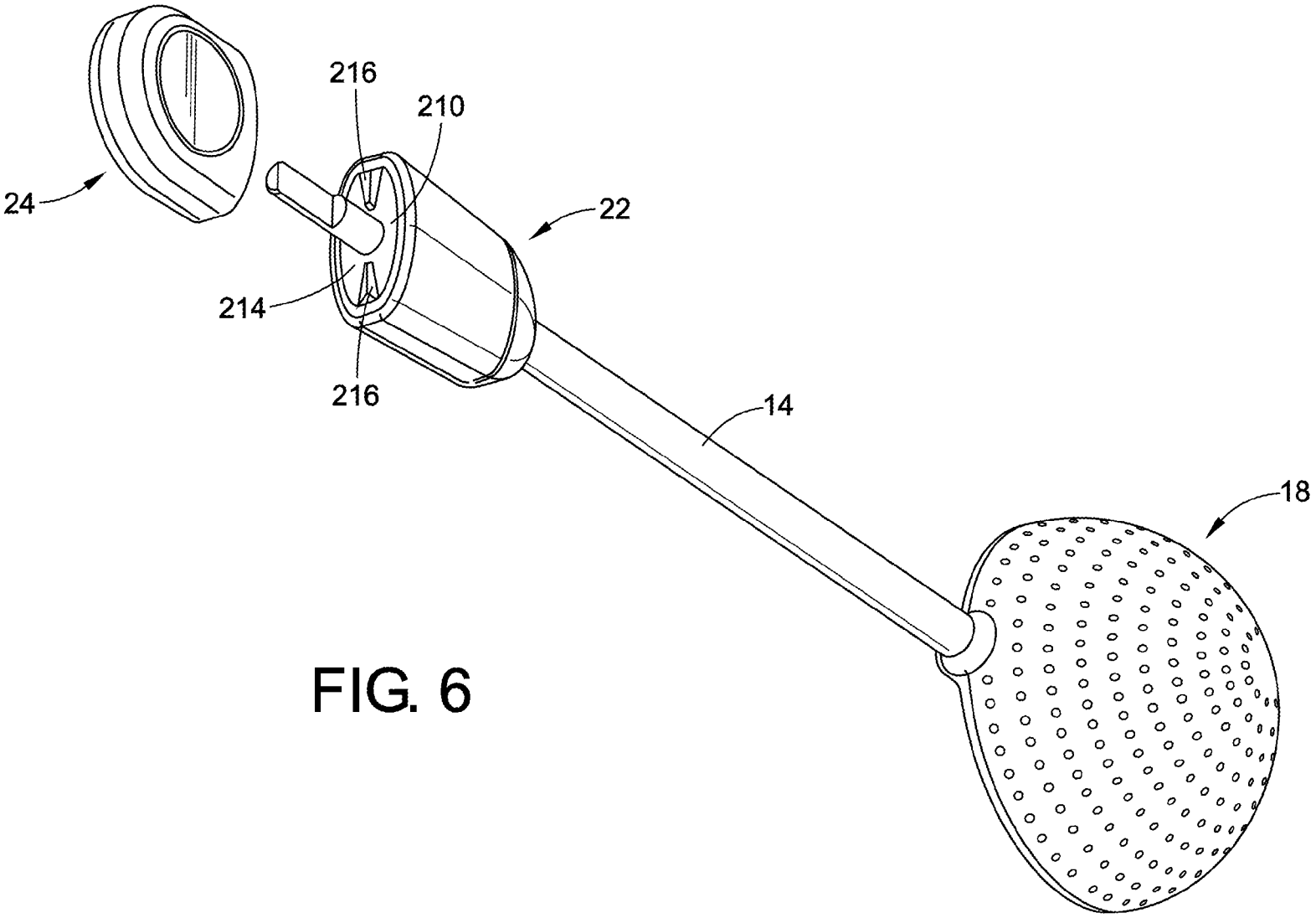
FIG. 6 is another partially exploded view of the device depicted in FIG. 1.

The detent mechanism 200 generally includes a translating member, or block, 210 and a spring 212. The translating member 210 is received in the non-circular counterbore 44 (FIG. 3) of the forward section 22 of the handle 12. The configuration of the translating member 210 in a cross-section taken normal to the rotational axis 34 is generally the same as the configuration of the non-circular counterbore 44 normal to rotational axis 34. With reference to FIG. 6, the translating member 210 includes a planar transverse surface 214, which faces the rear section 24 of the handle 12 and is generally normal to the rotational axis 34. Bumps 216 extend from the planar surface 214 in a direction toward the rear section 24 of the handle 12. The bumps 216 can take other configurations than that shown in FIG. 6. Also, the bumps could be spherical balls having a surface that extends from the planar surface 214 towards the rear section 24 of the handle. The bumps 216 could also be a press in stainless steel piece, similar to a nail with a hemispherical cap. With reference back to FIG. 4, the translating member 210 further includes a shoulder 218 formed at an end of the translating member 210 opposite the planar surface 214. The shoulder 218 cooperates with the spring 212 and the spring urges the translating member 210 toward the rear section 24 of the handle 12.

The spring 212 is received in the cylindrical rearward counterbore 52 (see FIG. 3) formed in the forward section 22 of the handle 12. The spring 212 is seated against the shoulder 218 of the translating member 210 and the shoulder 46 of the rear cylindrical counterbore 42. The spring 212 is a coil spring having a central passage 220. The spring 212 biases the translating member 210 toward the rear section 24 of the handle 12. The translating member 210 includes a central cylindrical passage 222 through which the rod 16 extends.

Figure 5:
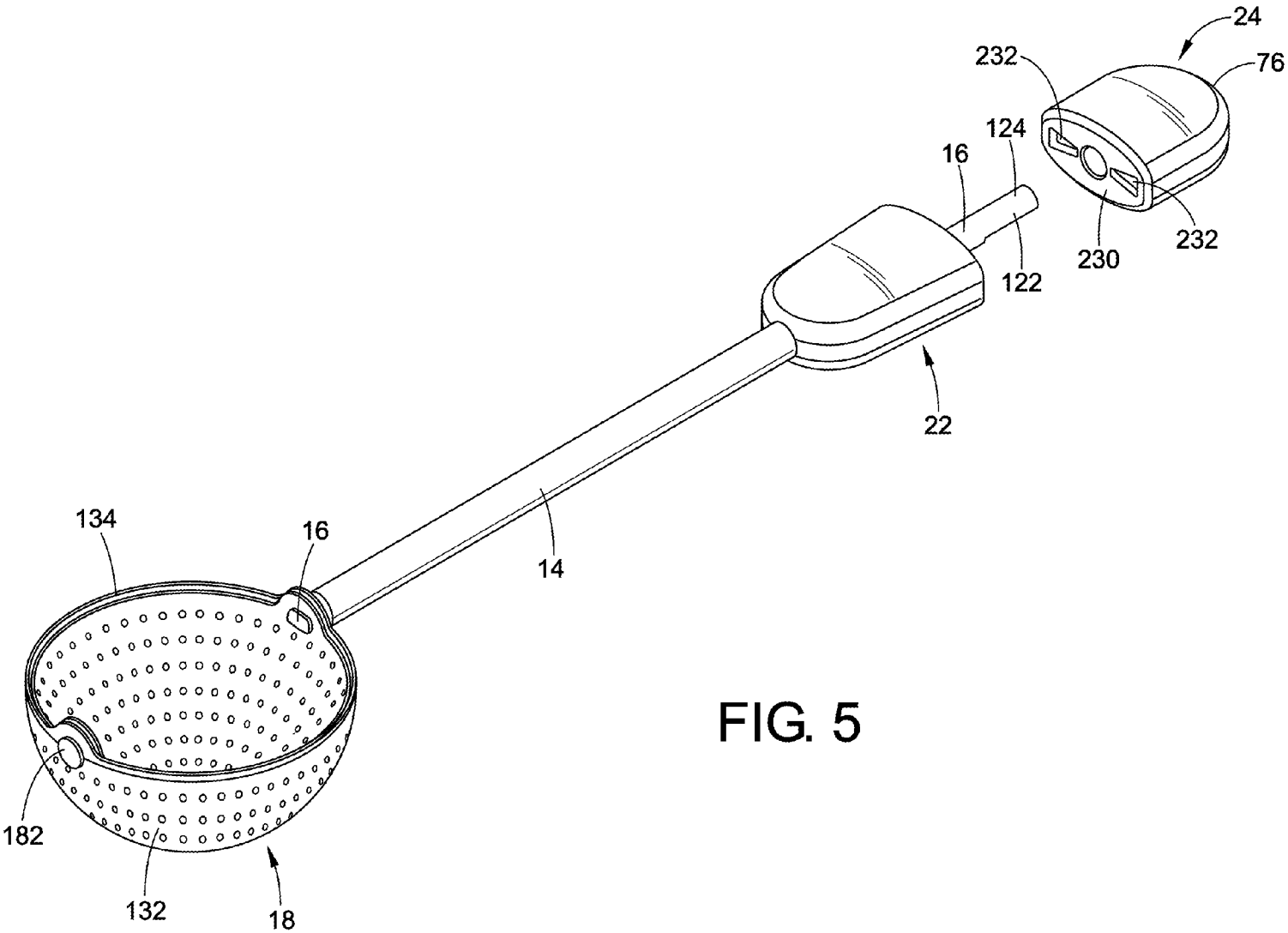
FIG. 5 is a partially exploded view of the device depicted in FIG. 1.

With reference to FIG. 5, the rear section 24 of the handle 12 includes a forward generally planar surface 230, which is generally normal to the rotational axis 34. Recesses 232, which are complementary in shape to the bumps 216, are formed in the forward section 24 of the handle 12 and extend from the forward planar surface 230 toward the rear end 76. When the basket 18 is in both the open position (FIG. 1) and the closed position (FIG. 2), the bumps 216 on the translating member 210 are received in the recesses 232 formed in the rear section 24. This can provide a tactile feature to the operator of the device 10 to indicate that the basket 18 is either opened or closed. Also, the forward generally planar surface 230 of the rear handle section 24 is covered by the forward handle section 22 when the basket 18 is in both the open position (FIG. 1) and the closed position (FIG. 2). However, at least a portion on each side to the rod 16 of the forward generally planar surface 230 of the rear handle section 24 is exposed (not covered by the forward section 22) when the basket 18 is in a position other than the closed position or the open position. This can provide the operator a visual indication that the basket 18 is either opened or closed.

The detent mechanism 200 was described above with the translating member 210 and the spring 212 disposed in the forward section 22 of the handle 12 and acting against the rear section 24 of the handle. Alternatively, the translating member 210 and the spring 212 could be located in the rear section 24 of the handle in an appropriately configured bore and act against the forward section 22. Also, the bumps 216, which operate as a male portion of the detent mechanism 200, could be formed or provided on the rear section 24 of the handle 12 and the complementary shaped recesses 232, which operates as a female portion of the detent mechanism, could be formed or provided on the forward section 22.

The device 10 further includes a gasket 240, which is visible in FIGS. 3 and 4. The gasket 240 precludes water from passing through the passage 118 in the tube 14 and exiting through the through bore 32 of the forward section 22 of the handle 12. The gasket 240 in the illustrated embodiment seals against the rod 16 and the interior cylindrical inner surface 48 of the rear cylindrical counterbore 44. The gasket 240 can be a flexible O-ring gasket.

An infusion/dispersion device has been described with particularity. Modifications and alterations will occur to those upon reading and understanding the preceding detailed description. Instead, the invention, however, is not limited to only the embodiment described above. The invention is broadly defined by the appended claims and the equivalents thereof.

The invention claimed is:

1. A device comprising:

a handle including a first section and a second section, wherein the second section is rotatable with respect to the first section;

a tube connected fast with the first section of the handle;

a rod received in the tube and connected fast with the second section of the handle;

a basket including an outer shell and an inner shell that is receivable in the outer shell, the outer shell connects fast with the tube and the inner shell connects fast with the rod such that rotation of the second section of the handle with respect to the first section of the handle results in rotation of the inner shell with respect to the outer shell; and a detent mechanism in the handle, wherein the detent mechanism is operable in a locked position in which rotational movement of the second section of the handle with respect to the first section of the handle is inhibited, wherein the detent mechanism includes a translating member received in one of the first and second sections of the handle and a spring biasing the translating member toward the other of the first and second sections of the handle, wherein the translating member includes a passage through which the rod extends.

2. The device of claim 1, wherein at least one of the outer shell and the inner shell includes perforations.

3. The device of claim 2, wherein the basket is movable into a closed position where the basket confines articles larger than the perforations within the basket and an open position where the inner shell is received within the outer shell and the basket defines an opening through which the articles can be loaded into the basket.

4. The device of claim 3, wherein the basket is spherical in configuration when in the closed position and the basket is hemispherical in configuration when in the open position.

5. The device of claim 3, wherein the second section of the handle rotates 180 degrees with respect to the first section of the handle when the basket is moved from the open position to the closed position.

6. The device of claim 3, wherein the first section of the handle is disposed forward from the second section of the handle toward the basket, wherein a forward surface of the second section of the handle is covered by the first section of the handle when the basket is in both the open position and the closed position.

7. The device of claim 6, wherein a side portion of the forward surface of the second section of the handle is exposed when the basket is in a position other than the closed position or the open position.

8. The device of claim 1, wherein the translating member includes a bump and the other of the first and second sections includes a recess that receives the bump when the detent mechanism is in the locked position.

9. The device of claim 1, wherein the translating member includes a recess and the other of the first and second sections includes a bump that is received in the recess when the detent mechanism is in the locked position.

10. The device of claim 1, wherein the first section of the handle includes a through bore extending through the first section of the handle, the rod is received in and extends through the through bore.

11. The device of claim 10, wherein the first section of the handle includes a non-cylindrical rear counterbore that receives the translating member.

12. The device of claim 1, wherein the device is one of a tea ball, a flour sifter or a flour wand.

13. A device comprising:

a handle including a first section and a second section, wherein the second section is rotatable with respect to the first section;

a tube connected fast with the first section of the handle;

a rod received in the tube and connected fast with the second section of the handle, the rod defining a rotational axis about which the second section of the handle rotates; and a basket including an outer shell and an inner shell that is receivable in the outer shell, the outer shell connects fast with the tube and the inner shell connects fast with the rod such that rotation of the second section of the handle with respect to the first section of the handle results in rotation of the inner shell with respect to the outer shell, wherein the first section of the handle is disposed forward from the second section of the handle toward the basket, wherein a forward surface of the second section of the handle is covered by the first section of the handle when the basket is in both the open position and the closed position, and wherein a side portion of the forward surface of the second section of the handle is exposed when the basket is in a position other than the closed position or the open position, further comprising a detent mechanism in the handle, wherein the detent mechanism is operable in a locked position in which rotational movement of the second section of the handle with respect to the first section of the handle is inhibited, wherein the detent mechanism includes a translating member received in one of the first and second sections of the handle and a spring biasing the translating member toward and against the other of the first and second sections of the handle.

14. The device of claim 13, wherein the translating member includes one of a bump and a recess that receives the bump when the detent mechanism is in the locked position and the other of the first and second sections includes the other of the bump and the recess.

15. The device of claim 13, wherein the first section of the handle includes:

a through bore extending through the first section of the handle, the rod is received in and extends through the through bore, and a non-cylindrical rear counterbore that receives the translating member, the translating member includes a passage through which the rod extends.

16. The device of claim 13, wherein the first section of the handle includes an external upper surface, an external lower surface, and external first and second side surfaces, a width of the first section is measured perpendicular to the rotational axis between the first and second side surfaces, the upper and lower surfaces of the first section are each wider than the side surfaces of the first section, and the second section of the handle includes an external upper surface, an external lower surface, and external first and second side surfaces, a width of the second section is measured perpendicular to the rotational axis between the first and second side surfaces, the upper and lower surfaces of the second section are each wider than the side surfaces of the second section.

17. The device of claim 16, wherein the basket is movable into a closed position where the basket confines articles within the basket and an open position where the inner shell is received within the outer shell and the basket defines an opening through which the articles can be loaded into the basket, wherein when the basket is in both the open position and the closed position the width of the second section is parallel to the width of the first section, and when the second section is rotated to move the basket from one of the closed and open positions to the other of the closed and open positions the width of the second section is rotationally offset from the width of the first section.

* * * * *